US005513409A

United States Patent [19]

Biegel

[11] Patent Number: 5,513,409

[45] Date of Patent: May 7, 1996

[54] FLOOR CLEANING ASSEMBLY INCLUDING GIMBALLING

[75] Inventor: Edward T. Biegel, Parker, Colo.

[73] Assignee: Windsor Industries, Inc., Englewood, Colo.

[21] Appl. No.: 321,808

[22] Filed: Oct. 12, 1994

[51] Int. Cl.[6] ..... A47L 11/162; A47L 11/283

[52] U.S. Cl. ..... 15/49.1; 15/98; 403/57

[58] Field of Search ..... 15/49.1, 50.1, 15/98, 230, 385; 403/57, 74, 359

[56] References Cited

U.S. PATENT DOCUMENTS

| | | | |
|---|---|---|---|
| 1,870,232 | 8/1932 | Brim | 15/49.1 |
| 2,007,073 | 7/1935 | Clarke | 15/49.1 |
| 2,114,967 | 4/1938 | Myers | 15/49.1 |
| 2,854,829 | 10/1958 | Porter | 403/74 |
| 3,376,675 | 4/1968 | Hutchins | 15/230 |
| 3,793,665 | 2/1974 | Thielen | 15/98 |
| 4,809,385 | 3/1989 | Bogue | 15/98 |
| 4,866,804 | 9/1989 | Masbruch | 15/49.1 |
| 4,888,843 | 12/1989 | Smith et al. | 15/98 |
| 4,924,634 | 5/1990 | MacKay, Jr. | 15/98 |
| 5,230,120 | 7/1993 | Ireson et al. | 15/98 |
| 5,259,085 | 11/1993 | Marafante et al. | 15/49.1 |

*Primary Examiner*—Edward L. Roberts, Jr.
*Attorney, Agent, or Firm*—Sheridan Ross & McIntosh

[57] ABSTRACT

A floor cleaning assembly including a gimballing connector is disclosed. The floor cleaning assembly includes a mounting member having an annular ring of bristles attached to the bottom surface thereof. The upper surface includes a centrally disposed hub and plurality of spokes and passageways extending radially therefrom. An annular barrier wall disposed adjacent the passageways extends upwardly from the upper surface of the barrier wall. The floor assembly is coupled to a motor drive by a gimballing connector which allows the axis of rotation of the floor assembly to shift relative to the axis of rotation of the motor drive. The geometry of the gimballing connector results in an evenly distributed wear pattern on the gimballing surface of the connector.

19 Claims, 11 Drawing Sheets

FLOOR CLEANING ASSEMBLY INCLUDING GIMBALLING

FIELD OF THE INVENTION

The present invention relates to machines for cleaning floors or other surfaces which utilize floor assemblies including scrubber brushes or pads to clean or polish the surface. More particularly, the present invention relates to a novel configuration for a rotatable floor assembly which includes gimballing capability and other features to facilitate even wear on the floor contact surfaces of the floor assembly.

BACKGROUND OF THE INVENTION

Many floor and street cleaning machines employ floor assemblies which include scrubber brushes or polishing pads which may be connected to rotating motor drives. The motor drives are typically oriented along, and rotate about, a substantially vertical axis. The floor assemblies are secured to a lower portion of the motor drives to allow the brushes or polishing pads to contact the floor. Scrubber brush assemblies commonly include a rigid disc-shaped member having bristles extending from one side thereof and an assembly for interconnecting the disc-shaped member with the motor drive. Similarly, polishing pad assemblies commonly include a rigid disc-shaped member connectable with the motor drive and having an assembly for connecting a polishing pad thereto.

To facilitate even wear on the floor contact surface of the floor assembly, it is desirable to maintain substantially constant contact between the floor contact surface and the floor while the cleaning machine is in operation. In this regard, it is desirable to allow the floor assembly to shift its axis of rotation relative to the axis of rotation of the motor drive to compensate for inclines or other deviations from the plane of the surface being cleaned. Further, it is desirable that the floor assembly have a geometric configuration which facilitates maintaining substantially even pressure on the floor contact surface of the cleaning assembly.

SUMMARY OF THE INVENTION

Accordingly, it is an object of the present invention to provide an interconnection between the motor drive shaft of a floor cleaning machine and a floor assembly which allows the floor assembly to shift its axis of rotation relative to the axis of rotation of the motor drive shaft.

It is another object of the present invention to provide a connection assembly between a rotating motor drive and a floor assembly attachable thereto which reduces uneven wear between connecting components thereof.

It is a further object of the present invention to provide a floor assembly having a geometric configuration which facilitates even wear across the floor contact surface connected to the floor assembly.

In accordance with the present invention an apparatus for use in maintaining desired contact with a floor is provided. One aspect of the invention provides a gimballing connection between a motor drive shaft of a floor cleaning machine and a floor assembly connected thereto. The apparatus preferably includes a drive member attachable to a motor drive shaft and having a gimballing surface. A driven member connectable with the drive member is provided for securing the floor assembly to the motor drive shaft. In operation, portions of the driven member contact the gimballing surface of the drive member along at least portions of the gimballing surface substantially greater than point contact. In one embodiment, such portions are simultaneously contacted and are located about an entire gimballing surface section that extends 360°. Even more preferably, portions of the driven member maintain contact with substantially the same gimballing surface of the drive member during any gimballing to facilitate even wear of the gimballing surface on the drive member.

More particularly, the drive member preferably includes a gimbal member having a plurality of sides and a substantially flat bottom surface with a gimballing surface disposed therebetween. In a preferred embodiment, the gimballing surface is a substantially continuously smooth curved surface, while in an alternate embodiment the gimballing surface may include a plurality of discrete curved surfaces. The drive member further preferably includes a motor connector for connection with the output shaft of a motor.

The floor assembly of the present invention preferably includes a driven member connectable with the drive member, a mounting member joined to the driven member, and a floor contact assembly for contacting the surface of the floor. The driven member preferably includes a plurality of inner walls and a gimballing surface disposed adjacent to the walls. In a preferred embodiment the gimballing surface includes a substantially continuously smooth curved surface and also includes the bottom surface of the driven member. In an alternate embodiment the gimballing surface may include a plurality of discrete curved surfaces and may also include the bottom surface of the driven member.

In a preferred embodiment, the mounting member is a substantially circular disk and the floor contact assembly extends from the lower side thereof for cleaning or polishing a surface. One embodiment of the mounting member preferably includes at least a first passageway disposed adjacent the driven member through which fluid may flow toward the cleaning surface and a barrier wall disposed adjacent said passageway to contain liquid flowing through the passageway.

In one embodiment, the lower side of the mounting member preferably includes a bevelled surface inclined at an oblique angle relative to the plane of the lower surface to facilitate securing a polishing pad to the mounting member. Preferably, the bevelled surface is inclined at an angle of less than about twenty degrees from the plane of the lower surface.

According to one aspect of the present invention the driven member preferably has a hardness different from the drive member. Even more preferably, the drive member has a harder material than the driven member to encourage more significant wear on the floor drive member than the drive member, thereby prolonging the useful life of the drive member.

Other objects and advantages of the present invention will become apparent from the following description with reference to the accompanying figures.

DETAILED DESCRIPTION

Figure 1:
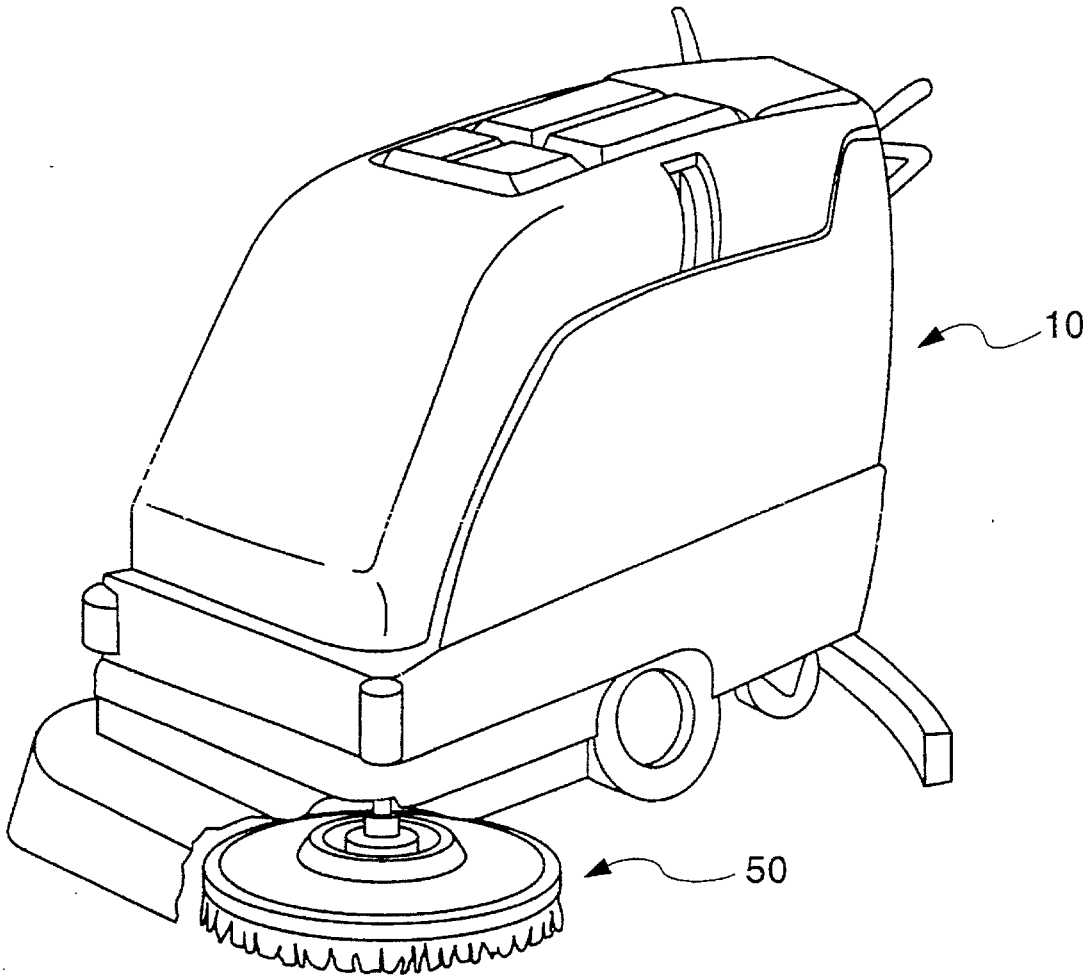
FIG. 1 is a perspective view of a floor cleaning machine which utilizes rotating floor assemblies for cleaning the surface of floors.
Figure 2:
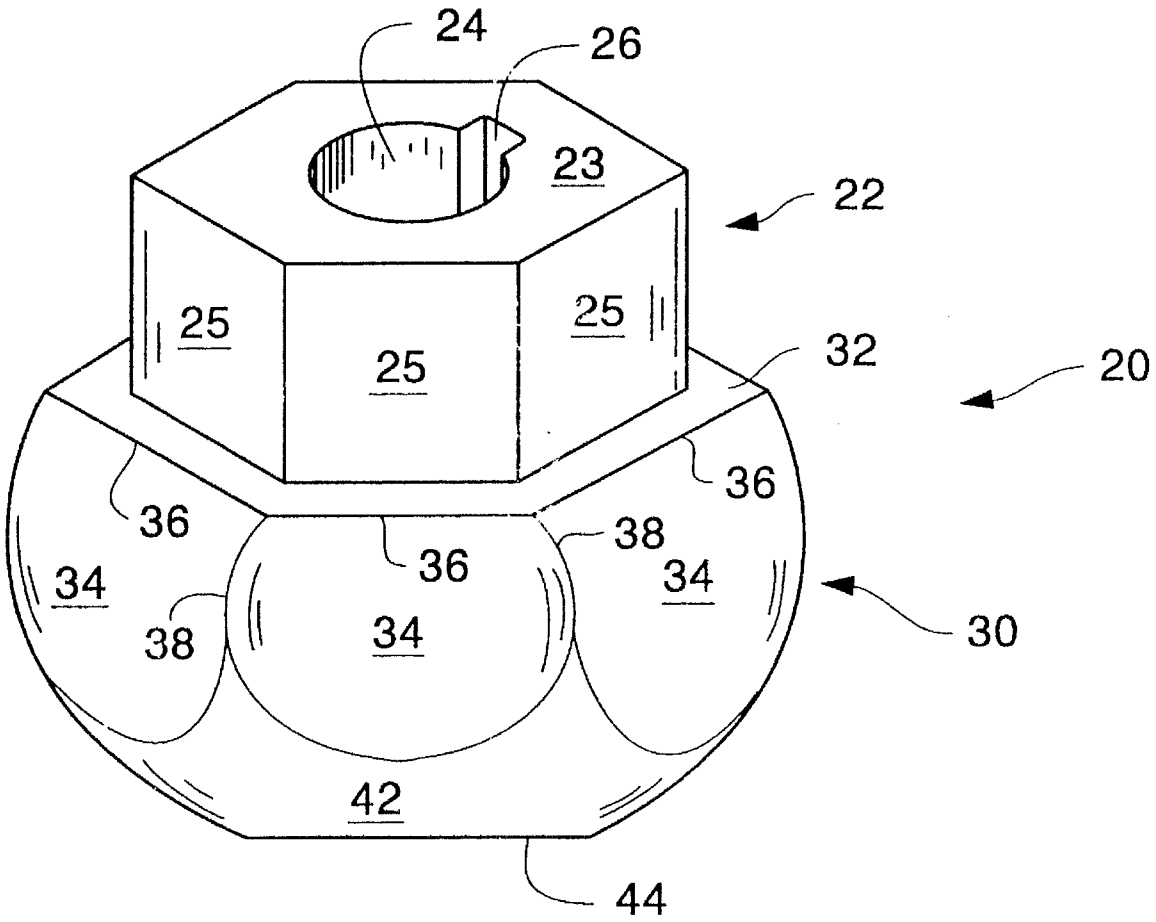
FIG. 2 is a perspective view, taken from above, of one embodiment of a drive member in accordance with the present invention.

Referring to FIG. 1, there is shown a floor cleaning machine 10 representative of the type which utilizes rotary brushes to clean floor surfaces. The floor cleaning machine 10 generally includes a body which houses fluid tanks, a vacuum assembly, and a drive assembly for driving dual rotary brushes. In operation, cleaning fluid may be directed onto the surface of the floor through one or more passageways in the floor assembly 50, which rotates to scrub or polish the surface of the floor being cleaned. Dirty fluid may be collected by suction and stored in tanks in the machine until it may be disposed of by dumping or other suitable means.

Referring now to FIGS. 2–6, there is illustrated one embodiment of a drive member 20 in accordance with the present invention. The drive member 20 is an integral part preferably manufactured from a suitable plastic material, however it should be appreciated that the material from which the drive member 20 is manufactured may vary. It is desirable, however, that the drive member 20 be formed from a harder material than the material from which the driven member 56 (FIG. 7) is formed to encourage more significant wear on the driven member 56 rather than on the drive member 20. The disclosed embodiment of the drive member 20 measures approximately 1.75 inches in height and approximately 2.0 inches in width, although the size of the drive member 20 is not critical and may vary according to the requirements of the particular application. The outer surfaces of the drive member 20 are substantially symmetrical about any vertical plane which bisects the drive member 20.

Figure 5:
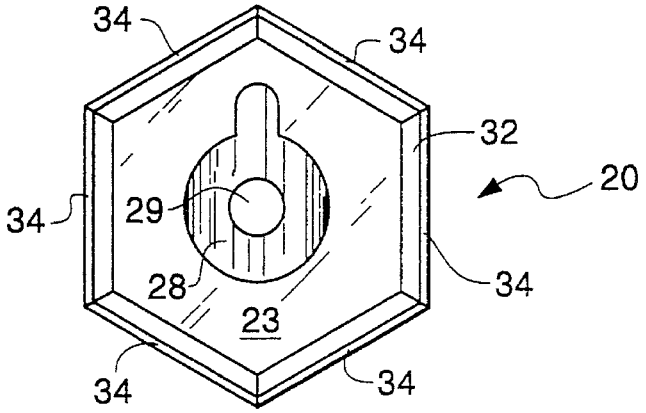
FIG. 5 is a top view of the drive member illustrated in FIG. 4.
Figure 4:
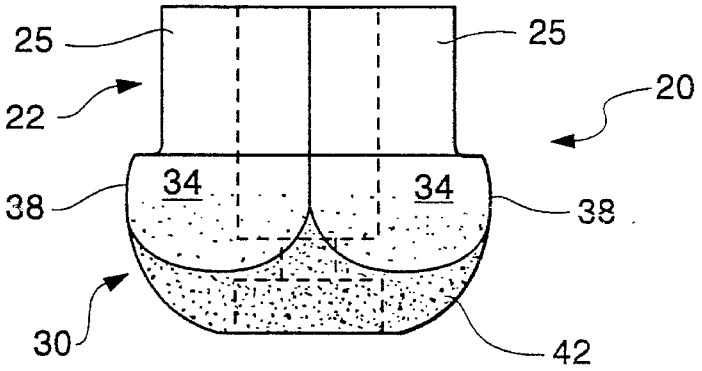
FIG. 4 is a side elevation view of one embodiment of a drive member in accordance with the present invention.
Figure 6:
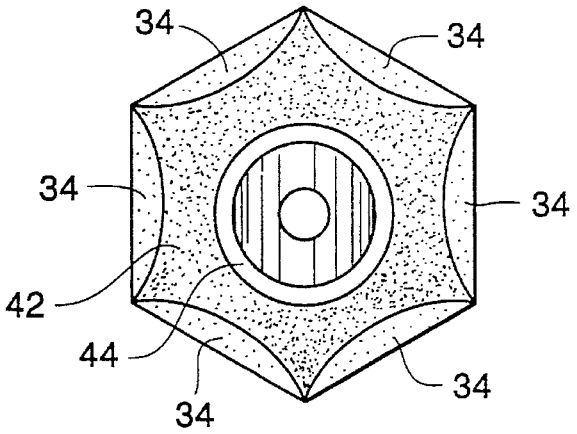
FIG. 6 is a bottom view of the motor drive member illustrated in FIG. 4.

The drive member 20 includes a motor connection member 22 for connecting the drive member 20 to a motor drive shaft of the floor cleaning machine 10. The motor connection member 22 is polygon shaped and preferably hexagonally configured and also has a substantially flat upper surface 23 and substantially flat side walls 25. A cylindrical bore 24 extends along a vertical axis through the center of motor connection member 22 for receiving a motor drive shaft. A groove 26 extends along the entire length of bore 24. Groove 26 mates with a key on the motor drive shaft for orienting the drive member 20 in a predetermined position relative to the motor drive shaft. As best illustrated in FIGS. 5 and 6, the floor 28 of bore 24 includes an aperture 29 to receive fasteners for mounting drive member 20 to a motor drive shaft.

The drive member 20 further includes a gimbal member 30 for establishing a gimballing connection with the floor assembly 50. The upper surface 32 of gimbal member 30 is substantially flat and has a hexagonal cross-section taken along a horizontal plane. The bottom surface 44 of gimbal member 30 is also substantially flat and has a circular cross-section taken along a horizontal plane. Six side walls 34 extend generally downwardly, outwardly and then inwardly from the edges 36 of the upper surface 32 and a gimballing surface 42 is disposed between the bottom surface 44 and the side walls 34 of gimbal member 30.

The upper edge 36 of each side wall 34 is substantially straight and extends along a line parallel to the plane of the adjacent side wall 25 of the motor connector member 22. The side edges 38 of each side wall 34 extend along a curved vertical line which is substantially parallel to the edges of side walls 25 of the motor connection member 22. The surface of each side wall 34 is substantially straight along any line crossing the side wall in a horizontal plane. However, the surface of each side wall 34 follows a radius of curvature, $R_1$, in the vertical plane.

A gimballing surface 42 is disposed between the lower edges 40 of side walls 34 and the bottom surface 44 and extends 360° around sections of the gimbal member 30. The gimballing surface 42 of the embodiment disclosed in FIGS. 2–6 is a substantially continuous, smoothly rounded surface which follows a radius of curvature, $R_2$, in the vertical plane. It has been determined that a smoothly-rounded gimballing surface 42 facilitates gimballing in any direction along the 360° encompassing gimballing member 30. However, it will be appreciated that gimballing surface 42 may comprise a discrete number of curved surfaces rather than a continuously smooth surface.

Figure 7:
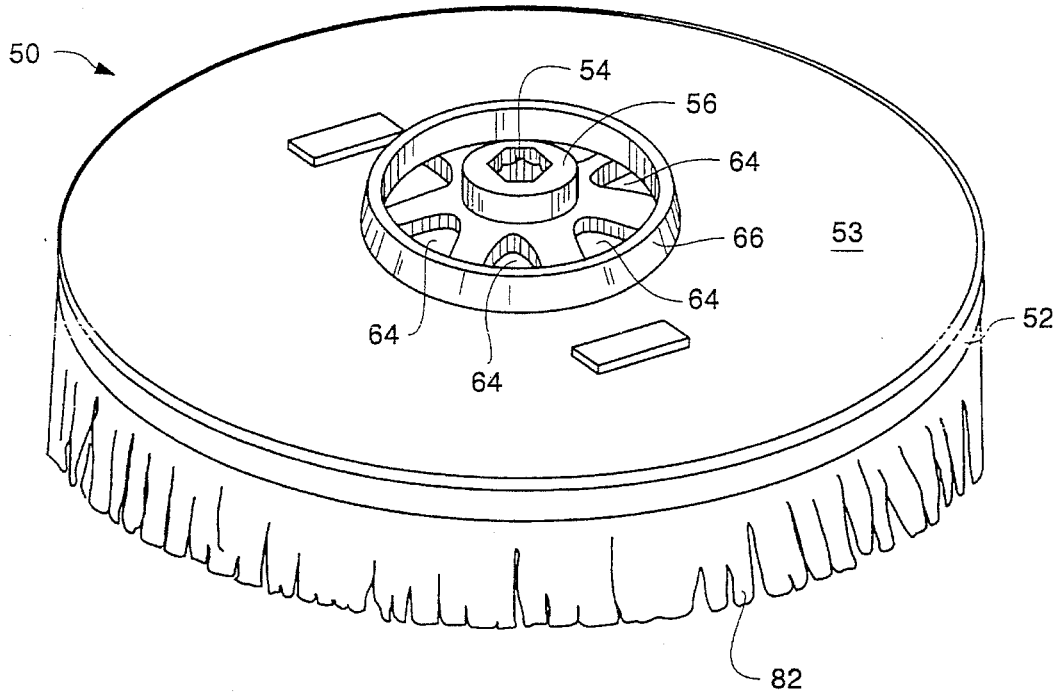
FIG. 7 is a perspective view, taken from above, of one embodiment of a floor assembly in accordance with the present invention.
Figure 8:
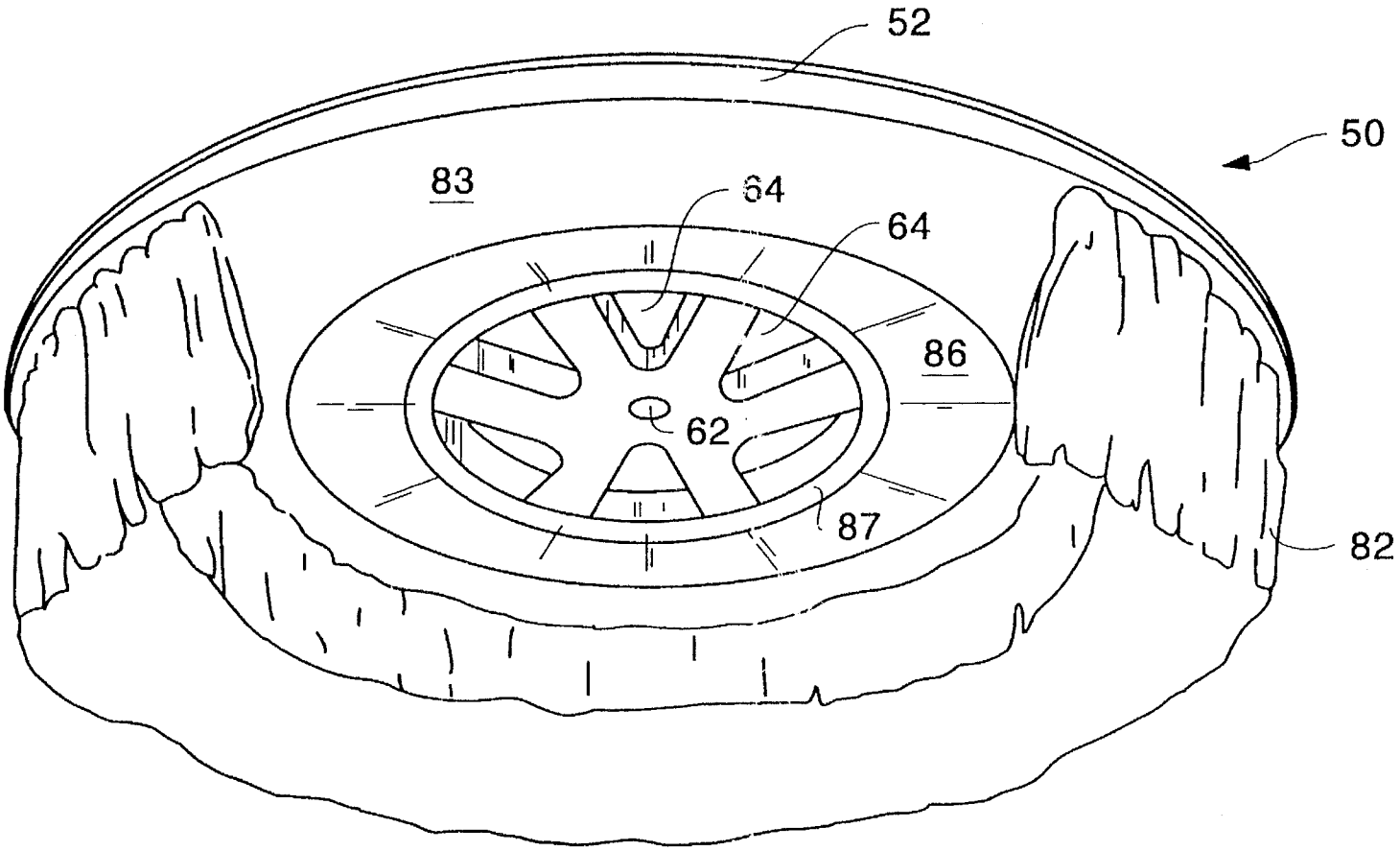
FIG. 8 is a perspective view, taken from below, of the floor assembly illustrated in FIG. 7.

FIGS. 7–8 illustrate a floor assembly 50 in accordance with one embodiment of the present invention having a plurality of bristles for cleaning a surface. The floor assembly illustrated in FIGS. 7–8 includes a disk-shaped mounting member 52 preferably formed from structural foamed polypropylene or another suitably rigid material. The disclosed mounting member 52 measures approximately seventeen inches in diameter and is approximately one inch thick at its edges. Further, mounting member 52 is substantially symmetrical about any vertical plane which bisects mounting member 52. It will be appreciated that the mounting member 52 may vary in size or may be manufactured from different materials depending upon the requirements of a particular application.

Referring to FIG. 7, a centrally disposed driven member 56 extends upwardly from the upper surface 53 of mounting member 52 and includes a hub 54 for establishing a connection with the gimballing member 30 of drive member 20.

In the disclosed embodiment the driven member 56 is an integral part of mounting member 52, however it will be appreciated that driven member 56 could be manufactured separately from mounting member 52 and secured thereto using conventional fasteners such as screws. A plurality of apertures 64 in the mounting member 52 extend radially from driven member 56. In operation, cleaning fluids from the floor cleaning machine 10 may be directed through apertures 64 in mounting member 52 toward the surface being cleaned. An annular barrier wall 66 disposed adjacent apertures 64 extends upwardly from the upper surface 53 of the mounting member 52 to prevent cleaning fluids from flowing radially along the upper surface 53 of mounting member 52. In the disclosed embodiment driven member 56 and barrier wall 66 extend upwardly approximately 1.3 inches from the upper surface 53 of mounting member 52. It will be appreciated by one of ordinary skill in the art, however, that the dimensions of driven member 56 and barrier wall 66 may vary in accordance with the particular requirements of the application.

Figure 9:
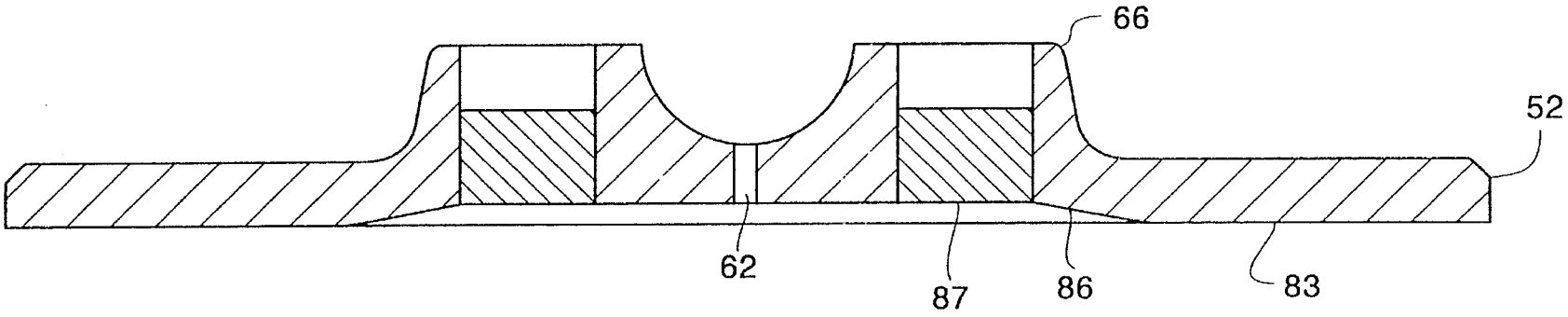
FIG. 9 is a cross-sectional view of a mounting member in accordance with the present invention.

Referring to FIGS. 8 and 9, the bottom surface of a mounting member 52 in accordance with principles of the present invention preferably includes a first region having a substantially flat bottom surface 83, a second region having a bevelled surface 86, and a third region having a flat bottom surface 87. Preferably, bevelled surface 86 forms an angle not greater than about 20° with the planes of surfaces 83 and 87. FIG. 8 illustrates a floor assembly 50 having an annular ring of bristles 82 approximately four inches thick extend from the bottom surface 83 of mounting member 52. The annular ring of bristles 82 defines a central region into which cleaning fluids may flow to facilitate cleaning of the floor surface. Bristles 82 are preferably formed from plastic or other suitable brushing material.

Figure 14:
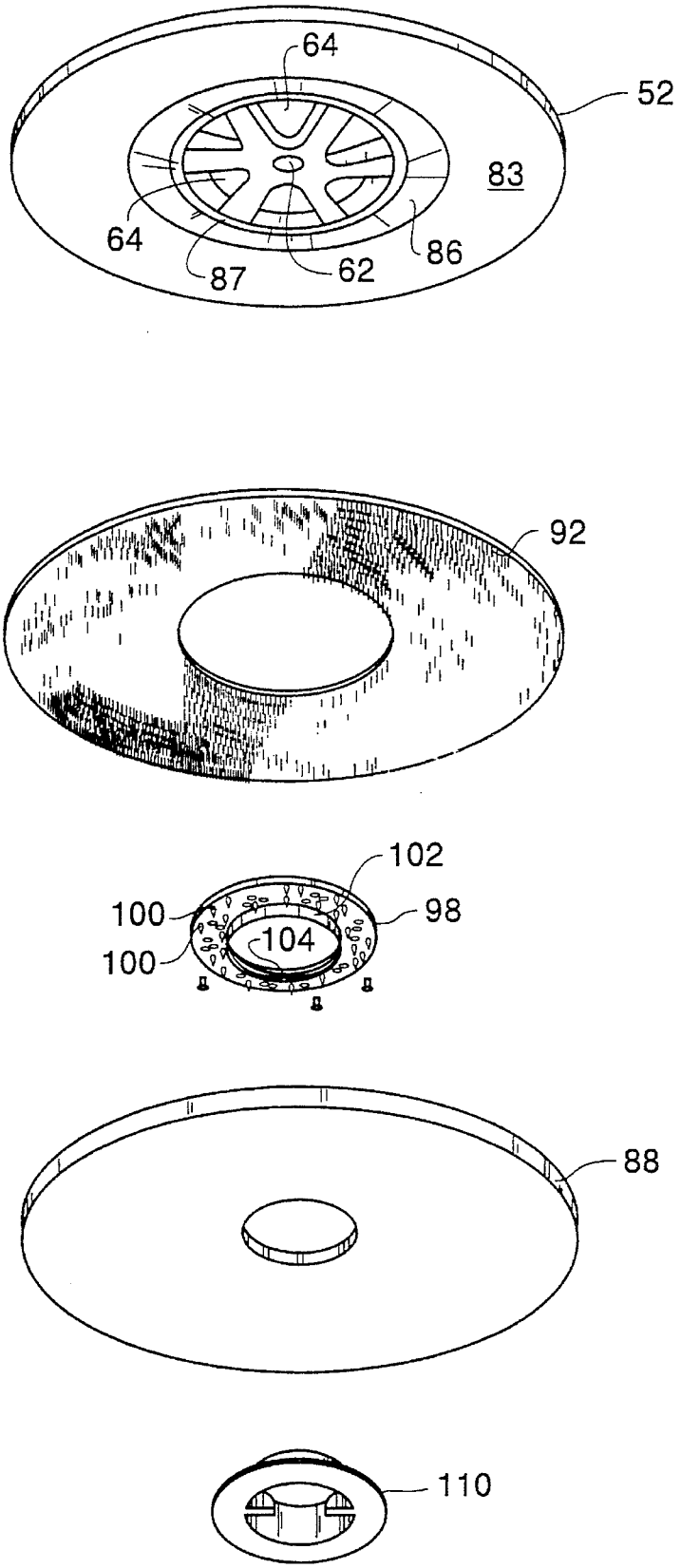
FIG. 14 is an exploded assembly view of a second embodiment of a floor assembly in accordance with the present invention.
Figure 15:
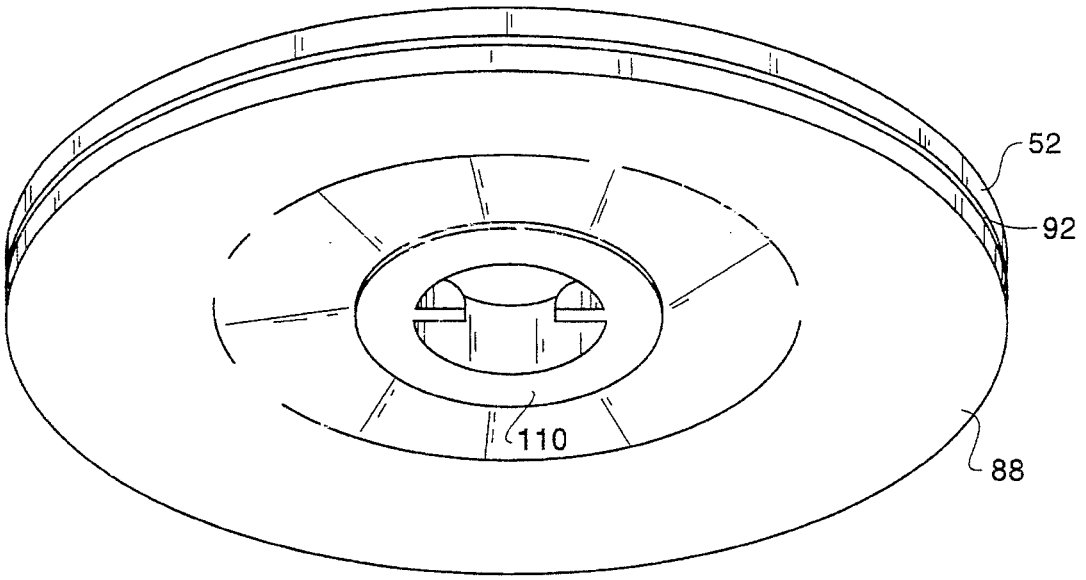
FIG. 15 is a perspective view of the floor assembly of FIG. 14.
Figure 16:
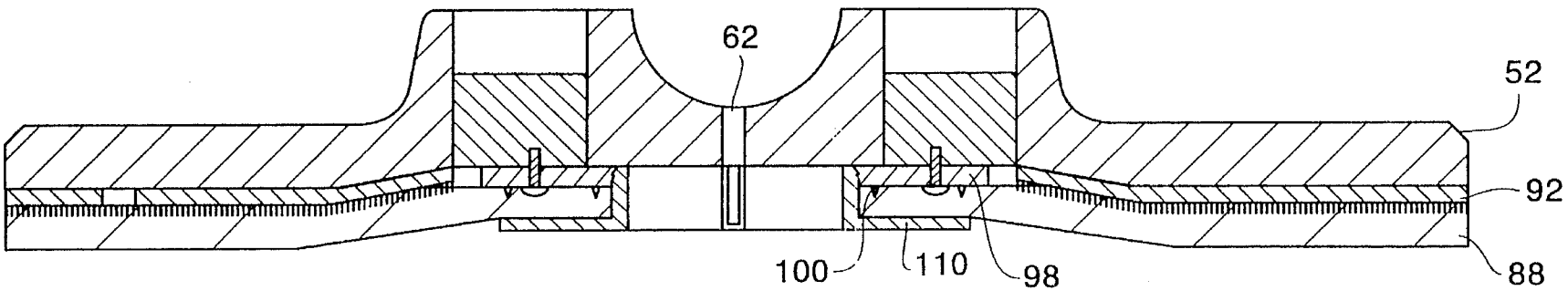
FIG. 16 is a cross-sectional view of the floor assembly of FIG. 15.

In accordance with present invention, the floor assembly depicted in FIGS. 14–16 may be adapted to use a polishing pad 88 to polish a floor surface rather than using bristles 82 to clean a floor. Polishing pad 88 is preferably a conventional disc-shaped floor polishing pad for use with a floor cleaning machine.

Referring to FIG. 14, a bristled mat 92 and a first clamp member 98 may be secured to bottom surface 87 of the mounting member 52 using conventional fasteners, such as adhesives or screws. Clamp member 98 includes a plurality of spikes 100 extending generally downwardly from the surface thereof for engaging portions of the polishing pad 88 and an annular wall 102 having threads 104 disposed on the inner side thereof. A second clamp member 110 is threadedly engagable with the first clamp member 98 to compressively engage portions of the polishing pad 88 therebetween.

The floor assembly depicted in FIG. 14 may be assembled by securing the bristled mat 92 and the first clamp member 98 to the mounting member 52. Next, the polishing pad may be fitted 88 onto the mounting member 52. Bristled mat 92 and the spikes 100 on clamp member 98 extend a short distance into the polishing pad 88 to help secure the pad 88 to mounting member 52. Finally, the second clamp member 110 is threadedly engaged to the first clamp member 98 to compressively engage the polishing pad 88 therebetween. Polishing pad 88 may be replaced when worn by simply removing the worn pad and fitting a new pad onto mounting member 52 in the same fashion as described above.

The assembled polishing pad floor assembly is depicted in FIGS. 15 and 16. It has been determined that compressively engaging a polishing pad 88 in a clamp may cause portions of the pad 88 adjacent the clamp member 110 to bulge or fray, creating an uneven surface on the bottom of polishing pad 88. In the absence of bevelled surface 86 on mounting member 52, bulges or frays in polishing pad 88 would contact the surface of the floor, resulting in uneven pressure across the contact surface of the polishing pad 88. However, because the portions of the polishing pad adjacent the clamp member 110 are recessed from the surface of the floor, such portions do not affect the pressure distribution of the polishing pad 88. Additionally, because the polishing pad is recessed along the gradual incline of bevelled surface 86, bulges and/or frays in the pad are reduced. Preferably, the angle that the bevelled surface 86 defines with a laterally extending line along the bottom surface of the mounting member 52 is less than about 20°.

Figure 10:
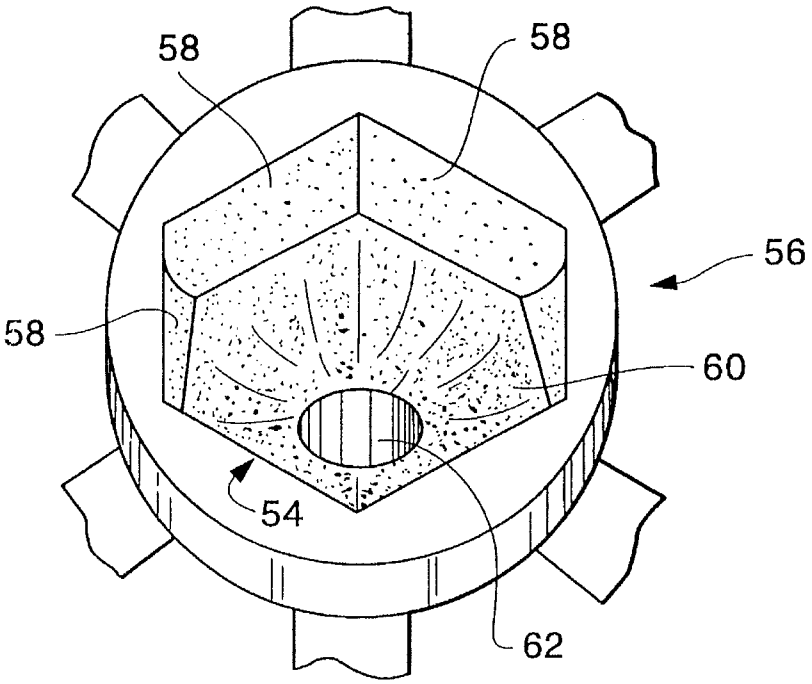
FIG. 10 is a perspective view, taken from above, of the driven member of the floor assembly.
Figure 3:
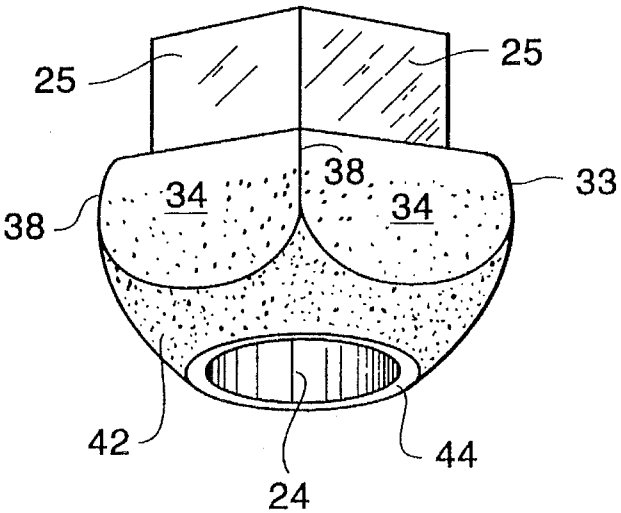
FIG. 3 is a perspective view, taken from below, of the drive member illustrated in FIG. 2.

Referring to FIG. 10, the driven member 56 will be explained in more detail. Driven member 56 includes a hub 54 having an upper portion defined by six substantially flat side walls 58 and a gimballing surface 60 disposed adjacent the side walls 58. Gimballing surface 60 is a substantially continuously smooth hemispherical bowl having a radius of curvature $R_3$ which is substantially the same as the radius of curvature $R_2$ of the gimballing surface 42 of the motor drive member 20. An aperture 62 at the bottom of the hub 54 extends through mounting member 52 to allow any fluids which may collect in the hub 54 of floor drive member 56 to pass though the mounting member 52 onto the surface below.

Figure 13:
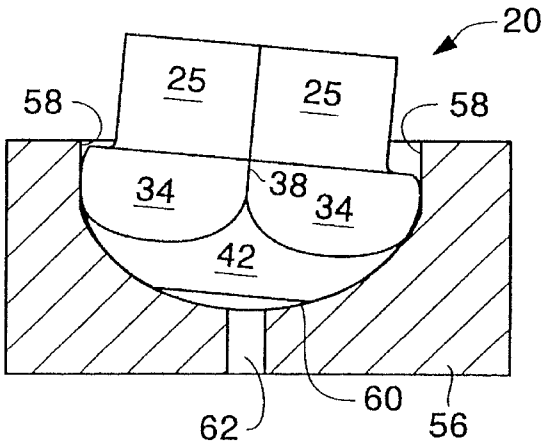
FIG. 13 is a longitudinal cross-sectional view, similar to FIG. 11, but illustrating gimballing in a second direction.
Figure 12:
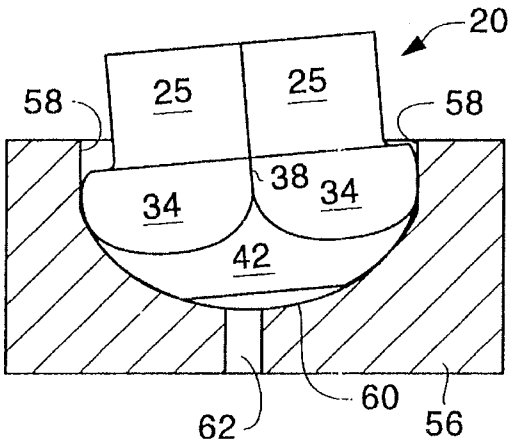
FIG. 12 is a longitudinal cross-sectional view, similar to FIG. 11, but illustrating gimballing in a first direction.
Figure 11:
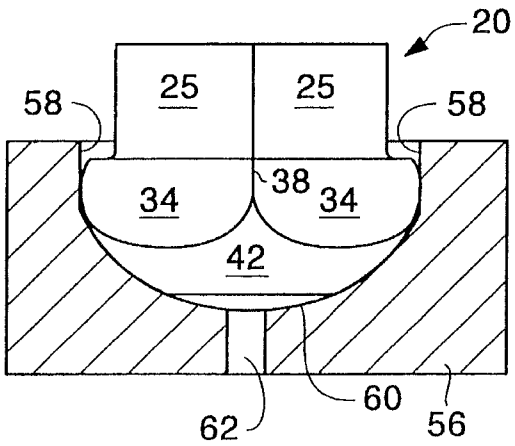
FIG. 11 is a longitudinal cross-sectional view of the driven member in contact with a drive member, taken across a vertical plane bisecting the driven member, illustrating the interconnection between surfaces of the drive member and the driven member when the axes of these two members are aligned.

FIGS. 11–13 illustrate the connection between the drive member 20 and the driven member 56. FIGS. 11–13 are cross-sectional views of the hub 54 taken along a vertical plane which bisects hub 54. Drive member 20, however, is pictured in a full side view, rather than a cross-sectional view, to better demonstrate the connection between drive member 20 and the driven member 56. FIG. 11 illustrates the connection when the axis of rotation of the floor assembly 50 substantially corresponds with the axis of rotation of the motor drive shaft of the floor cleaning machine 10. FIG. 12 illustrates the connection when the floor assembly 50 is gimballed such that the axis of rotation of the floor assembly 50 is angularly displaced from the axis of rotation of the drive shaft in a first direction. FIG. 13 illustrates the connection when the floor assembly 50 is gimballed such that the axis of rotation of the floor assembly 50 is angularly displaced from the axis of rotation of the drive shaft in a second direction.

As conveyed by FIGS. 11–13, the gimballing surface 42 of drive member 20 and the mating gimballing surface 60 of driven member 56 maintain substantially greater than point contact across the entire range of gimballing motion. Simultaneous contact occurs at all times during gimballing among portions of these two gimballing surfaces 42, 60, which portions of the gimballing surface 42 are found along 360° sections thereof. The substantially greater than point contact results in at least two portions of the gimballing surface 42 which are spaced at least 90° from each other along the 360° extent of the gimballing surface 42, simultaneously contacting portions of the mating gimballing surface 60. Preferably, the mating parts result in substantially the entire gimballing surface 42 of the drive member 20 maintaining contact with portions of the gimballing surface 60 of the driven member 56 across the entire range of angular displacement. Maintaining contact between substantially the entire gimballing surface 42 of the drive member 20 and the mating gimballing surface 60 of the driven member 56 facilitates even wear on the drive member 20.

In operation, the drive member 20 is secured to the motor drive shaft of a floor cleaning machine of the type which utilizes rotating brushes to clean the surface of the floor. A floor assembly 50 is then secured to the drive member 20 by positioning the gimballing member 30 within the driven member 56 and locking the two together using a conventional locking assembly, such as a retention spring or locking collar. The gimballing interconnection allows the floor assembly 50 to shift its axis of rotation relative to the axis of rotation of the motor drive shaft. Accordingly, floor assembly 50 is able to compensate for inclines or other deviations in the surface being cleaned in order to maintain substantially constant contact between the floor contact surface of bristles 82 and the floor.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. For example, it would be obvious to one of ordinary skill in the art to modify the shape of the mating gimballing surfaces by changing their respective radii of curvature or by providing gimballing surfaces having a discrete number of curved surfaces rather than a continuously smooth surface.

Further, the embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. An apparatus for use in maintaining desired contact with a floor, comprising:

a drive member including a motor connector, a bottom surface and a gimbal member disposed between said motor connector and said bottom surface, said gimbal member having a plurality of discrete sides and having a gimballing surface adjacent to said sides with each of said sides having a first curvature that extends inwardly in a vertical direction adjacent to said gimballing surface, said gimballing surface having a second curvature in a vertical plane different from said first curvature;

a floor assembly including:

a driven member having a cooperating surface that mates with said gimballing surface to contact said drive member gimballing surface along substantially greater than point contact during gimballing of said drive member;

a mounting member joined to said driven member; and means for contacting the floor joined to said mounting member.

2. An apparatus, as claimed in claim 1, wherein:

said drive member gimballing surface includes at least first and second portions spaced at least 90° from each other and in which both of said first and second portions simultaneously contact said driven member during gimballing.

3. An apparatus, as claimed in claim 1, wherein:

said drive member gimballing surface includes a section that extends 360° and during gimballing said section simultaneously contacts said driven member.

4. An apparatus, as claimed in claim 1, wherein: portions of said driven member maintain simultaneous contact with said same portions of said drive member gimballing surface during any gimballing.

5. An apparatus, as claimed in claim 1, wherein;

said bottom surface of said drive member is substantially flat.

6. An apparatus, as claimed in claim 1, wherein: each of said sides terminates in a straight edge.

7. An apparatus, as claimed in claim 1, wherein: said gimballing surface comprises a substantially continuously smooth curved surface.

8. An apparatus, as claimed in claim 1, wherein: said gimballing surface comprises a discrete plurality of curved surfaces.

9. An apparatus, as claimed in claim 1, wherein:

said motor connector is polygon shaped with said plurality of sides of said gimbal member being equal to said polygon shaped motor connector.

10. An apparatus, as claimed in claim 1 wherein:

said gimballing surface comprises a substantially continuously smooth curved surface.

11. An apparatus, as claimed in claim 1, wherein:

said gimballing surface comprises a discrete plurality of curved surfaces.

12. An apparatus, as claimed in claim 1, wherein:

said driven member includes a plurality of inner walls, each of said inner walls terminating in a straight edge.

13. An apparatus, as claimed in claim 1, wherein:

said mounting member includes passageway means adjacent to said driven member and including at least one port through which liquid is able to flow towards the floor.

14. An apparatus, as claimed in claim 13, wherein:

said mounting member includes a barrier wall with said passageway means being provided between said barrier wall and said driven member, said barrier wall having a sufficient height to contain substantially all liquid that flows towards the floor through said passageway means.

15. An apparatus, as claimed in claim 1, wherein:

said cooperating surface of said driven member includes a number of inner walls and said gimbal member contacts at least two of said inner walls during gimballing of said gimbal member and in which at least one of said inner walls of said driven member remains free of contact from said gimbal member.

16. An apparatus, as claimed in claim 1, wherein:

said driven member is made of a different material than said drive member with said drive member different material being harder than said driven member material.

17. An apparatus, as claimed in claim 1, wherein:

said mounting member includes a plate section having a lower side and an upper side with said lower side having an inclined section that is inclined at an angle different from 90° to facilitate receipt of a pad.

18. An apparatus, as claimed in claim 1, wherein:

said means for contacting includes a brush member.

19. An apparatus for use in maintaining desired contact with a floor, comprising:

a drive member including a motor connector, a bottom and a gimbal member disposed between said motor Connector and said bottom, said gimbal member having a gimballing surface and said bottom terminating said drive member, said bottom being the lowest portion of said drive member when said drive member is vertically upward with said motor connector being vertically above said bottom; and a floor assembly including:

a driven member having a cooperating surface that contacts said gimballing surface of said drive member during gimballing of said drive member, said bottom of said drive member being free of contact from said driven member including said cooperating surface, and said bottom not locking said drive member to said driven member, said drive member having a bore hole extending completely through said bottom thereof, said bore hole including means for receiving a fastener for mounting said drive member to a motor shaft;

a mounting member joined to said driven member; and means for contacting the floor joined to said mounting member.

* * * * *